United States Patent [19]

James

[11] 3,962,737

[45] June 15, 1976

[54] LIFTING MEANS

[75] Inventor: David Richard James, Hasfield, England

[73] Assignee: Mecanaids, Limited, United Kingdom

[22] Filed: July 19, 1974

[21] Appl. No.: 490,125

Related U.S. Application Data

[63] Continuation of Ser. No. 256,581, May 24, 1972, abandoned.

[30] Foreign Application Priority Data

May 28, 1971 United Kingdom ..... 18035/71

[52] U.S. Cl. ..... 5/86; 5/81 R; 254/7 R; 280/47.16

[51] Int. Cl.[2] ..... A47B 83/04

[58] Field of Search ..... 254/2 R, 3 R, 4 R, 7 R, 254/94; 280/150 A, 47.16; 5/86, 87, 81 R, 81 B

[56] References Cited

UNITED STATES PATENTS

| | | | |
|---|---|---|---|
| 1,878,785 | 9/1932 | Leavitt | 5/86 |
| 2,285,699 | 6/1942 | Everest | 280/47.16 |
| 2,959,791 | 11/1960 | Ramsey | 5/86 |
| 3,137,011 | 6/1964 | Fischer | 5/86 |
| 3,629,880 | 12/1971 | Van Rhyn | 5/86 |
| 3,829,916 | 8/1914 | James | 5/86 |

FOREIGN PATENTS OR APPLICATIONS

| | | | |
|---|---|---|---|
| 218,600 | 8/1956 | Australia | 5/86 |

*Primary Examiner*—Al Lawrence Smith
*Assistant Examiner*—Robert C. Watson
*Attorney, Agent, or Firm*—Cushman, Darby & Cushman

[57] ABSTRACT

An invalid hoist has a wheeled chassis with a rear mounting for an upstanding column and lifting arm. The chassis comprises a cross member with main load-carrying wheels adjacent the ends thereof and three fore-and-aft wheel-carrying arms projecting from the cross member. Two of the arms extend forwardly in spaced relation to leave an opening between them and the third arm extends rearwardly to support the column.

8 Claims, 5 Drawing Figures

LIFTING MEANS

This is a continuation of application Ser. No. 256,581, filed May 24, 1972, now abandoned.

This invention relates to invalid hoists for lifting and transporting persons who are disabled or infirm. It is particularly concerned with such hoists having an upstanding support column from which a lifting arm projects and which is mounted on a wheeled chassis.

The main functions of an invalid hoist or patient handling apparatus are to transfer a patient from one sitting or reclining place to another by lifting and lowering him and in many cases moving him in the transferring process from one location to another, it may be through passages or in confined spaces. Typical sitting or reclining places are a bed, chair, wheelchair, bath, W.C. pan and motor car.

The invention has for an object to provide a hoist particularly well suited for these functions, in particular to deposit a patient in and lift him from a wheelchair and to transport him to and from a W.C. pan, and which can have a general construction, particularly as regards chassis dimensions, which suits the hoist for domestic use.

According to one aspect of the invention an invalid hoist has a wheeled chassis with a rear mounting for an upstanding column and lifting arm, and comprising a cross member with main load-carrying wheels adjacent the ends thereof and three fore-and-aft wheel-carrying arms projecting from the cross member, two of the arms extending forwardly in spaced relation to leave an opening between them and the third arm extending rearwardly to support the column.

The wheels may have fixed axes or be castors of any type, and reference herein to "wheels" is to be construed accordingly as including any wheel and axle assembly or castor arrangement.

The chassis is inherently low lying with an open or forked front portion and a rear portion of small lateral dimensions, and in its preferred form, the front portion is not only low lying to move beneath a bed or a bath but also has a forward opening such that it will fit around a W.C. pan. Furthermore the arms are preferably dimensioned so that a wheelchair may be moved over and across the chassis to a position in which the forward arms of the chassis lie between the wheels of the chair beneath the latter and the rear arm passes between the wheels of one side of the chair. To this end the rear arm should be narrow at least in the part of its length between the cross member and the column mounting and lateral obstructions on either side of the arm close to the cross member should be avoided. The forward arms, to fit beneath the wheelchair, need to be of shorter length than the lateral spacing of the wheels of a typical wheelchair.

The rear arm is preferably provided with a mounting, such as a tubular socket, for a detachable column, and a column extension piece fitting the mounting may be provided for increasing the mounted height of the column. The rear arm may be of about the same length as the forward arms and may be disposed centrally of the cross member.

The arm lengths should also be chosen so that the centre of gravity of the hoist lies just in front of the cross member or, more specifically, the axis of the load-bearing wheels, so that the front wheels are normally operative and the chassis can be tipped back on to the rear castor with relatively little effort.

For simple construction, cleanliness, light weight and adequate strength for the loads to be carried, a welded chassis with a tubular cross member, tubular forward arms and a box-section or channel-section rear arm is appropriate but the members may be of other single or multiple beam formation of lateral dimensions small compared with the length dimension.

The chassis may be collapsible, folding about a lateral axis at the cross member, for convenience of storage and transport. With five wheels the chassis provides for maximum manoeuvrability in domestic situations. The two front wheels may be castor wheels or have fixed axes. The two main load-carrying wheels preferably have fixed axes and the rear wheel is preferably a castor wheel. As already indicated, the chassis is preferably arranged to tilt about the two main wheels so that the front and rear wheels are alternatively operable, and the two main wheels are desirably relatively large for rolling over carpet edges and the like. The length of the arms should be chosen so that the centre of gravity of the apparatus is disposed just in front of the main wheel axis so that the front wheels or castors are normally operative and the chassis can be tipped back on to the rear castor with relatively little effort.

The invention in another aspect lies in an invalid hoist having a wheeled chassis with a column mounting adjacent the rear end of the chassis, the chassis having an opening forward of a cross member such that it will fit around a W.C. pan, and a rear member with a narrow portion behind the cross member and extending rearwardly to the column mounting so that an invalid chair may be wheeled over and across the chassis to a position in which the wheels of one side of the chair straddle the narrow portion. In this relative position the chair wheels should clear the front part of the chassis providing the forward opening, and to this end the forward length of the chassis from the cross member is preferably less than the lateral spacing of the wheels of a typical wheelchair.

An embodiment of the invention, in the form of an invalid hoist or patient handling apparatus designed particularly with domestic use in mind, will now be described by way of example and with reference to the accompanying drawings, in which.

Figure 1:
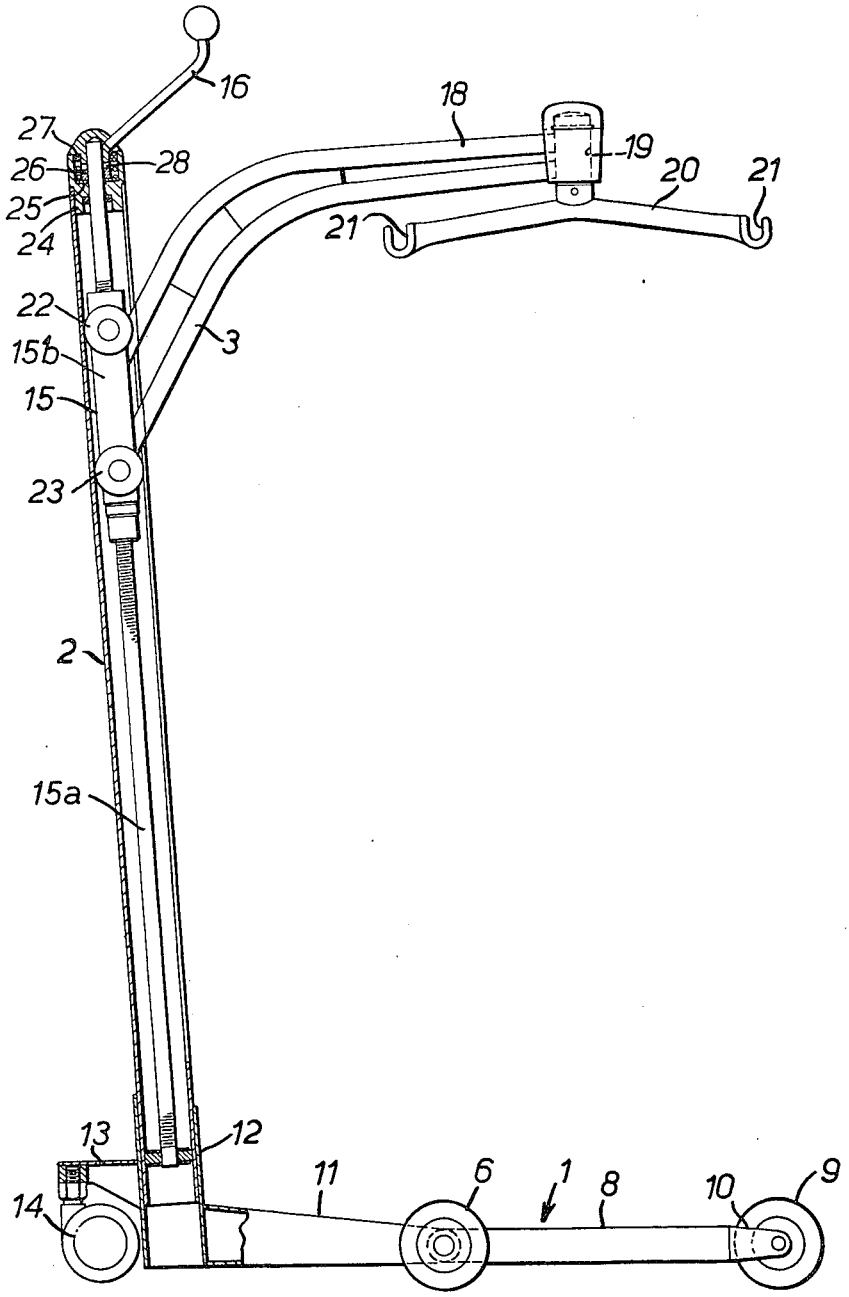
FIG. 1 is a side view of the hoist.

The hoist comprises a low-lying wheeled chassis 1 with a column 2 upstanding from the rear end from which column extends a lifting arm 3. The chassis has a single tubular cross member 4 with main load-bearing wheels 5 and 6 mounted coaxially one at each end. Two tubular side arms 7 and 8 are welded to the cross member 4 near the respective ends of the latter to extend forwardly in cantilever fashion with an initial curvature such as to lie mainly in the radial planes of the main wheels 5 and 6, so leaving open a space between them approaching the overall width of the chassis. Each of the arms 7 and 8 has a wheel 9 mounted in a forked extremity 10, the wheels 9 having a common axis parallel to that of the wheels 5 and 6.

Rearwardly and centrally of the cross member 4 there extends a single box-section arm 11, fixed as a cantilever by welding. Near the end of the arm 11 is a short length 12 of box-section with a vertical axis providing a socket for the column 2 and a bracket 13 on the side of the length 12 carries a castor wheel 14. The bracket 13 serves as a foot-step.

Horizontal and vertical bracing, axle-rod interconnection of the front wheels and chassis-length side cheeks are all avoided insofar as they would obstruct the spaces between the arms 7 and 8, on each side of the arm 11 and above the chassis.

The wheel axes are arranged so that the chassis can be tilted through a small angle from a stable loaded position, in which the wheels 5, 6 and 9 are loaded, to a position, in which the load is taken by the wheels 5, 6 and the castor wheel 14. This provides for manoeuvering and steering the hoist and for riding over carpet edges and the like. At the same time the hoist is stably mounted against fore-and-aft tipping. Sideways tipping is prevented by adequate lateral spacing of the wheels but subject to this consideration the chassis width is kept small for reasons to be described.

Lateral forces on the arms 7, 8 and 11 during use, as well as loading forces on the arm 11, on the individual front wheels 5, 6 and on the rear castor wheel 14, are all resisted by the cantilever fixing of the arms at the cross member 4. In the result a very light-weight construction is achieved for the loads to be carried, this being important for domestic use.

Further and special advantage is attached to the use of the cantilevered arms 7, 8 and 11 projecting fore-and-aft from the cross member 4 in that the chassis besides being low-lying is open at the front and has a narrow, low-lying neck immediately behind the cross member, this neck being constituted by the arm 11 and extending rearwardly to the column 2 and the space between the cross member and the lower end of the column being otherwise clear of obstruction. The resulting facilities are described hereinafter and enhance the value of the hoist for domestic home use.

The column 2 of square-section contains a screw jack 15 coupled to a winding handle 16 at the top of the column. The jack screw 15 operates the lifting arm 3 which is upwardly and forwardly cranked and projects forwardly of the column. The free end 18 of the arm 3 is approximately horizontal and has a fixed vertical bearing 19 for a tubular lateral hanger 20 which projects symmetrically on both sides of the arm bearing 19. At the ends the hanger 20 has a hook formation 21 to support patient support slings, whereby to support a patient in a sitting position.

Figure 3:
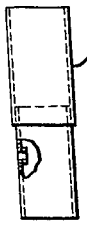
FIG. 3 is a view of an extension piece for increasing the lifting range.
Figure 2:
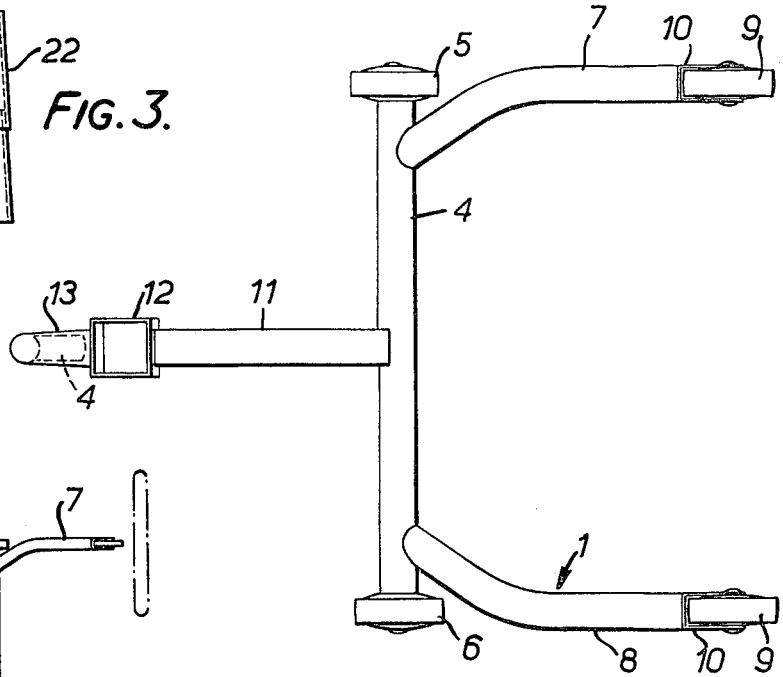
FIG. 2 is a plan view of a chassis portion of the hoist.

For raising a patient on to an abnormally high bed, an extension piece 22 as shown in FIG. 3 may be interposed between the column 2 and the socket.

Figure 5:
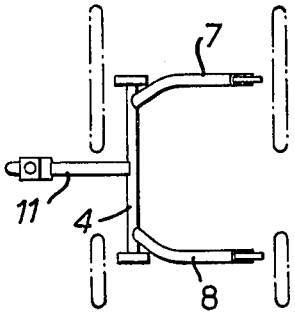
FIG. 5 is a plan view of the hoist in relation to the wheels of a wheelchair while a patient is being moved to or from the chair.
Figure 4:
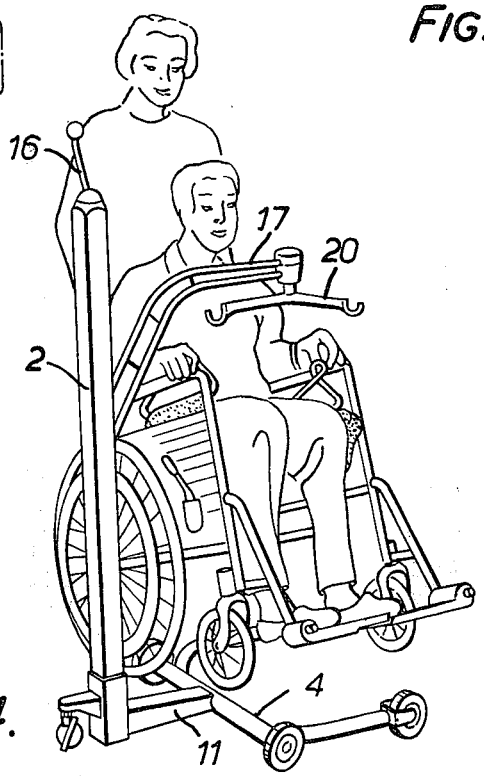
FIG. 4 is illustrative of the use of the hoist in moving a patient to and from a wheelchair.

In use, with a patient supported, the centre of gravity is disposed slightly forwardly of the chassis cross member 4. The spacing of the front chassis arms 7 and 8 enables them to be wheeled around a W.C. pan, with the patient positioned above the W.C. seat. An invalid wheelchair can be wheeled sideways across the chassis, as illustrated in FIG. 4, the chair being tipped to clear the rear central chassis arm 11. Thus the chair is positioned below the patient support position, with the chassis cross member 4 between the adjacent front and rear chair wheels and the other chair wheels outside the front limit of the chassis, as shown in FIG. 5.

Typical, but non-limiting, dimensions for the apparatus are as follows:

Overall chassis length 32 inches.

Length of front chassis side member 18 inches.

Overall width of front chassis section 24 inches.

Clearance height of chassis 3¾ inches.

Reach of lifting arm, i.e. spacing between column and hanger bearing, 18 inches.

Minimum height of hanger 21 inches above ground.

Lift available 30 inches.

As shown in FIG. 1, the column 2 is inclined rearwardly so that the patient is lifted from a lowermost forward position to a raised position in which the centre of gravity is closer to the vertical plane of the wheels 6, to improve the stability as the load rises and provide increased "reach" in the lowered position.

The screw 15*a* of the screw jack 15 housed in the column 2 is directly connected to the winding handle 16 mounted at the upper end of the column, and the portion of the jack which runs along the screw comprises a carriage 15*b* inside the column. The arm 3 is attached to the carriage 15*b* and projects through a longitudinal slot in the column. The carriage has two pairs of wheels 22,23 which respectively run on the inner surfaces at opposite side walls of the rectangular section column 2.

As shown the handle 16 turns at the top of the column 2 and is associated with a friction clutch arrangement operative to brake the screw against the weight of a patient suspended on the arm 3 and to provide a frictional torque opposing lowering movement by the handle 16, the clutch being inoperative when the handle is turned to raise the arm. To this end the fixed head 24 of the column is fitted with a friction pad 25 engaged by an annular clutch member 26 within a spiral spring 27 the lower end of which is fixed to the clutch member 26. A boss of the handle 16, fixed on the screw 15*a*, has a cylindrical part fitting inside the loose upper end of the spring and is supported on a thrust bearing race 28 between that part and the clutch member 26. In the descent of the load, the clutch becomes operative as a result of tightening of the spring which grips the handle boss so that the clutch member 26 turns with the screw on the friction pad 25, whereby to introduce a frictional torque. This torque is also available to brake the lifting mechanism against any tendency for the weight of the loaded arm to overrun the screw jack 15.

When the handle 16 is turned in the opposite direction to raise the arm, the handle boss turns freely within the spring 27 and thus the clutch is inoperative. The clutch member 26 remains stationary and no frictional braking torque is applied to the handle and screw which turn on the thrust race 28.

I claim:

1. An invalid hoist comprising a wheeled chassis, an upstanding column mounted on and adjacent the rear of the chassis, and a lifting arm projecting from the column, said chassis having a cross-member, two arms secured to and extending forwardly from said cross-member in spaced relation to leave a front opening between them and being provided adjacent their forward ends with fixed-axis load-carrying front wheels, two laterally spaced fixed-axis load-carrying wheels rotatably conected proximate the ends of said cross-member and being secured to said cross-member and extending rearwardly therefrom to define a T-shaped rear portion of said chassis, disposed intermediate the front wheels and the column, a rear member and a castor support wheel mounted on said rear member adjacent the rear of the chassis, the arrangement being such that the chassis with a patient supported thereon normally rests on the front and intermediate wheels with the rear wheel free of the ground but, for purposes of maneuvering, the hoist can be tilted back about the intermediate wheels onto the rear castor wheel.

2. An invalid hoist according to claim 1, wherein the forward arms have over the major part of their length a spacing approximately equal to the spacing of the intermediate wheels

3. An invalid hoist according to claim 1, wherein the forwardly extending arms are tubular and welded to said cross member which is also tubular, the rear member being of channel or box section.

4. An invalid hoist according to claim 1, wherein the hoist has a center of gravity that lies just in front of the intermediately disposed load-carrying wheels.

5. An invalid hoist according to claim 1, wherein the column houses a screw jack with a screw directly connected to an operating winding handle mounted at the top of the column and a carriage which runs along the screw inside the column, the arm being attached to the carriage and projecting from the column through a longitudinal slot therein, and a clutch arrangement which is associated with the screw is operative to brake the screw against the weight of a patient suspended on the arm and to provide a frictional torque opposing lowering movement by the handle, the clutch being inoperative when the handle is turned to raise the arm.

6. An invalid hoist according to claim 1, wherein the front wheels carried by the forwardly extending arms and the wheels carried by said cross-member are fixed axis wheels arranged in a symmetrical generally rectangular disposition, and the rear wheel and the load-carrying wheels being arranged in a symmetrical triangular disposition.

7. An invalid hoist having a wheeled chassis comprising a column mounting adjacent the rear end of the chassis, an intermediate cross member, main load-carrying fixed axis wheels respectively mounted adjacent the ends of the cross member, front load-carrying fixed axis wheels respectively mounted adjacent front corners of the chassis, the front end of the chassis being open between the front wheels back to the cross member, a rear member extending rearwardly from the center of the cross member to the column mounting, a castor wheel mounted on the rear member adjacent the rear end of the chassis, the hoist having a center of gravity with a patient supported thereon that is disposed just in front of the common axis of the side wheels, the main load-carrying and the front wheels having coplanar ground-contact points and the ground-contact point of the rear wheel being disposed in a different plane so that the chassis can be tilted about the main load-carrying wheels to rest on the front wheels or on the rear wheel, and side members of the chassis extending forwardly from the cross member and carrying the front wheels and providing a U-shaped front portion of the chassis, said rear member being disposed central of the cross member thus providing a T-shaped rear portion of the chassis.

8. An invalid hoist having a wheeled chassis comprising: a cross-member, side members extending forwardly from the cross-member and defining therewith a U-shaped front portion of the chassis, a rear member being secured centrally of said cross-member and defining therewith a T-shaped rear portion of the chassis, side main load-carrying fixed axis wheels respectively mounted adjacent the ends of said cross-member, front load-carrying fixed axis wheels respectively mounted proximate the forwardly extending ends of each of said side members, the front portion being open between the front wheels and said cross-member, a castor wheel mounted on said rear member remote from said cross-member, a column mounted proximate the remote end of said rear member, a lifting arm projecting from said column capable of supporting a patient, said hoist having a center of gravity with a patient supported thereon which is disposed just in front of said common axis of said main load-carrying fixed axis wheels, the main load-carrying and the front wheels having coplanar ground contact points and the ground contact point of the rear wheel being disposed in a different plane so that the chassis can be tilted about the main load-carrying wheels to rest on the front wheels or on the rear wheel.

* * * * *